US012029959B2

(12) United States Patent
Grasso et al.

(10) Patent No.: US 12,029,959 B2
(45) Date of Patent: Jul. 9, 2024

(54) SUPPORT PART OF A STARTING BLOCK IN SWIMMING

(71) Applicant: SWISS TIMING LTD, Corgemont (CH)

(72) Inventors: Christophe Grasso, Bienne (CH); Frederic Choffat, Alle (CH); Camille Mairot, Le Valdahon (FR)

(73) Assignee: SWISS TIMING LTD, Corgemont (CH)

( * ) Notice: Subject to any disclaimer, the term of this patent is extended or adjusted under 35 U.S.C. 154(b) by 236 days.

(21) Appl. No.: 17/843,289

(22) Filed: Jun. 17, 2022

(65) Prior Publication Data

US 2023/0118589 A1 Apr. 20, 2023

(30) Foreign Application Priority Data

Oct. 14, 2021 (EP) ..... 21202607

(51) Int. Cl.

| | |
|---|---|
| ***A63B 5/10*** | (2006.01) |
| ***A63B 24/00*** | (2006.01) |
| ***A63B 71/06*** | (2006.01) |
| ***E04H 4/14*** | (2006.01) |

(52) U.S. Cl.

CPC ..... *A63B 71/0605* (2013.01); *A63B 5/10* (2013.01); *A63B 24/0062* (2013.01); *A63B 71/0622* (2013.01); *E04H 4/144* (2013.01); *A63B 2220/51* (2013.01); *A63B 2220/833* (2013.01); *A63B 2225/74* (2020.08); *A63B 2244/20* (2013.01)

(58) Field of Classification Search

CPC ..... A63B 71/0605; A63B 5/08; A63B 5/10; A63B 2005/085; A63B 24/0062; A63B 71/0622; A63B 2225/74; E04H 4/144

USPC ..... 4/496

See application file for complete search history.

(56) References Cited

U.S. PATENT DOCUMENTS

| | | | | |
|---|---|---|---|---|
| 11,013,977 | B2 | 5/2021 | Santino, Jr. | |
| 2012/0192346 | A1* | 8/2012 | Maas | A63B 5/10 4/496 |
| 2014/0165282 | A1* | 6/2014 | Colletto | A63B 5/10 4/496 |
| 2016/0256721 | A1* | 9/2016 | Abe | A63B 31/00 |

FOREIGN PATENT DOCUMENTS

| | | | |
|---|---|---|---|
| KR | 10-2012-0028518 | A | 3/2012 |
| WO | 2015/159007 | A1 | 10/2015 |

OTHER PUBLICATIONS

European Search Report 21 20 2607 dated Mar. 9, 2022.

* cited by examiner

*Primary Examiner* — Huyen D Le
(74) *Attorney, Agent, or Firm* — Sughrue Mion, PLLC

(57) ABSTRACT

A support part of a swimming start block. The front support part (18) is provided for a starting block (1) of a swimming race, which includes at least one base (9) to be fixed around a swimming pool, and a platform (5) which is mounted or fixed on the base (9). A foot of a swimmer as well as his hands are supported before the start of a race on the front support part. This front support part is arranged to be mounted interchangeably on a front portion of the platform (5) of the starting block (18) and can be an intelligent front support part with motion sensors and light source and race management electronics.

10 Claims, 2 Drawing Sheets

SUPPORT PART OF A STARTING BLOCK IN SWIMMING

CROSS REFERENCE TO RELATED APPLICATION

This application claims priority to European Patent Application No. 21202607.4 filed Oct. 14, 2021, the entire contents of which are incorporated herein by reference.

FIELD OF INVENTION

The invention relates to a support part of a starting block or aid of a swimming race. The support part is preferably an intelligent front support part with race management electronics.

BACKGROUND OF THE INVENTION

For a swimming race, there are provided starting aids arranged respectively in each race lane, often in numbers of 10 lanes. Each swimming starting block is particularly adapted to the type of swimming race during a competition. The starting blocks are all disposed on the same border line on two sides of the swimming pool. The swimmer is supported on an upper platform of the starting aid for a crawl-type, breaststroke-type or dolphin-type race. It can be supported for these types of swimming on a front portion of the starting aid, which is defined as a nose or also on an inclined thrust plane disposed rearward of the platform.

Generally, a swimmer on the platform bears, before the start of the race on the front portion of the platform with his hands and one foot, while the other foot bears on a plane inclined rearwardly of the platform. Thus, it is noted that the grip is worn out quickly on the front portion in front of the platform. This requires the replacement of the entire platform if the wear of the front portion is too significant, which is a drawback.

FIG. 1 precisely represents a traditional starting aid or block 1 which comprises a platform 5 and an inclined plane 3 towards the rear of the platform 5, and a base 9 for fixing, to the ground, the starting aid 1 at the edge of a swimming pool. The starting aid 1 also comprises a structure in the form of bars 7 which are fixed to the base 9 or to the platform 5 of the starting aid 1 for a swimming race on the back.

A drawback of such a starting aid is that, if the front portion is worn out, given that the hands and one foot of a swimmer are supported and grip on the front portion for the start of a race, it is necessary to replace the entire platform. Changing the platform represents significant costs if it is necessary to replace them often. In addition, this requires more manipulations for fastening to the ground at the edge of the swimming pool.

U.S. Pat. No. 7,193,167 B1 describes a starting aid fixed to the edge of a swimming pool. This starting aid comprises a platform fixed on a base and a stair step on the rear of the platform. In addition, the platform comprises on the front a light source to illuminate by a flash the moment of the start of a race.

A drawback of such a system is that if the front portion is worn out quickly due to the hands gripped on the front and a foot as described in FIG. 1 above, it is necessary to completely replace the starting aid.

The patent application EP 2 457 623 A1 describes a starting aid with a platform connected to a base fixed to the ground at the edge of the swimming pool and on which a swimmer bears before the start of a race. A front portion is mounted on the front of the platform and is displaceable in the direction of the platform. At least one foot and the hands of a swimmer can be placed on the front portion. The front portion comprises force sensors to detect a reaction time in order to determine in particular a false start.

A drawback of such a starting aid structure is that if the front portion is damaged by the hands and a foot of swimmers, this complicates the replacement of at least the front portion due to the complicated mobility structure thereof with the rest of the platform.

The patent application KR 2012 0028518 A describes a support part for a starting block of a swimming race. The starting block comprises at least one base fixed around a swimming pool and a platform which is mounted or fixed on the base and on which the swimmer and his hands are supported before the start of a race. The support part is a front support part which is arranged to be mounted interchangeably on a front portion of the starting block platform. However, specific means for fixing or holding the front support part in a suitable opening in the front portion of the platform are not specified.

SUMMARY OF THE INVENTION

The object of the invention is therefore to overcome the drawbacks of the aforementioned prior art by proposing a front support part, for example intelligent front support part, of a starting block or aid of a swimming race.

The front support part is a front portion mounted on the front of the platform and on which a foot of the swimmer and the hands gripped on the front portion are supported.

To this end, the invention relates to a front support part of a starting block or aid of a swimming race, which comprises the features defined in the independent claim 1.

Particular embodiments of the support part of a starting block or aid are defined in the dependent claims 2 to 10.

An advantage of the support part of the starting block lies in the fact that said front part is defined as a nose of the platform. This front portion is easily detachable from the platform to change it in case of wear of the grip. It is ergonomic and quickly interchangeable in case of wear. This allows having a better grip and a better feeling for the athlete, a feeling of quality and confidence. It is easily nestable and detachable from the front portion of the platform. Moreover, since it is small in size, it can easily be sent to any country in the world, which is not the case for an entire platform.

Another advantage is that the support part or front support part comprises a light source to illuminate through a slot on the front or the top of the front portion or in order to generate a flash to signal the start of a race. However, the "entertainment" functionality is not only used to give the start, but also to provide information or to make the show during the race, or at the end of the race.

Another advantage lies in the fact that force sensors or strain gauges are disposed in the front portion or nose in order to determine in particular a reaction time. The sensor signals are received by a processor processing unit. If the reaction time is too short and before the start signal, a false start is detected by the processing unit.

BRIEF DESCRIPTION OF THE DRAWINGS

The aims, advantages and features of the intelligent front support part of a starting block or aid for a swimming race will appear better in the following description of non-limiting embodiments illustrated by the drawings in which.

DETAILED DESCRIPTION OF THE INVENTION

In the following description, the well-known elements of a starting block with a support part on the front of the platform for a swimming competition, will only be described in a simplified manner.

Figure 1:
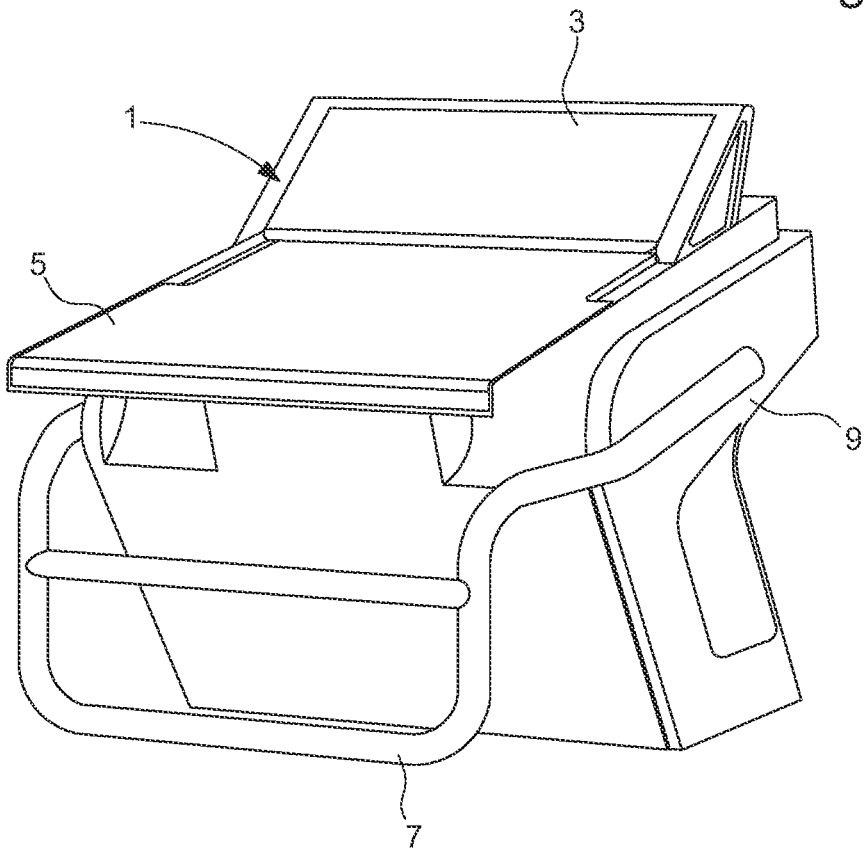
FIG. 1 represents a starting block according to the prior art.
Figure 2:
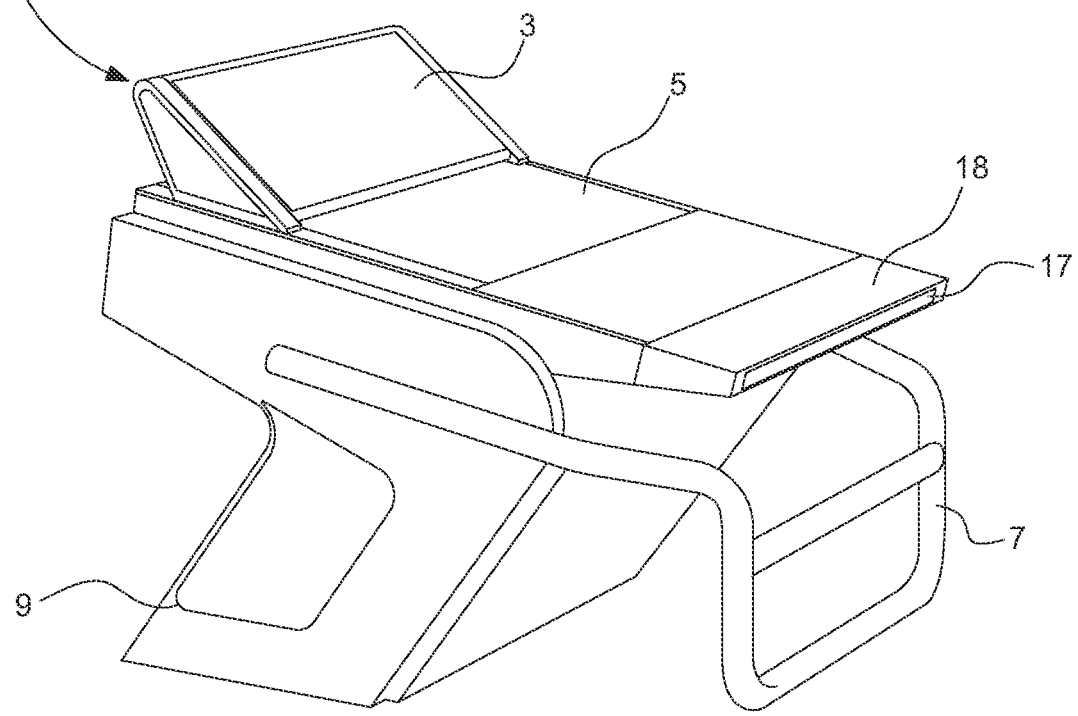
FIG. 2 represents an embodiment of a starting block with a front support part which is intelligent and interchangeable with an illumination on the front according to the invention.

FIG. 2 represents an embodiment of the starting block 1. The starting block 1 comprises a platform 5 which is mounted or fixed on a base 9 or integral with the base 9, whose lower portion is fixed on a ground around a swimming pool. The starting block 1 may further comprise on the rear portion of the platform 5, an inclined plane 3. The starting block may further comprise a structure in the form of bars 7 fixed on the base 9 or the platform 5 for a backstroke swimming race. This structure of metal bars 7 is shown with two horizontal bars connected at the ends thereof by two vertical bars, which extend in the direction of the starting block 1 by two more or less rectilinear bars on each side of the base 9 so as to be fixed at the end thereof at said base 9 of the starting block 1.

The starting block or aid 1 comprises, as an essential portion of the present invention, a support part 18 as a front support part or nose, which is mounted so as to be interchangeable on the front of the platform 5. The support part 18 can be changed following a wear, for example a grip of the front support part 18 when several swimmers come to grip the front support part 18 with their hands and place a foot on the front support part 18 before and for the start of a swimming race.

The support part 18 is an intelligent front support part as a front portion of the platform 5. It comprises, for example, electronics for race management and mainly race start. The intelligent front support part 18 comprises at least one force or movement sensor (triaxial accelerometer) or a strain gauge, or several other sensors. The sensors, which are not represented, are generally connected to a processor or microcontroller processing unit to process sensor signals so as to determine in particular a swimmer's reaction time on the front support part at the time of start of a swimming race.

In addition, the front support part 18 comprises at least one light source for illuminating according to a first embodiment through a slot 17 disposed horizontally on the front of the front support part 18 and preferably over the entire length, at least the race lane in front of the starting block. The light source in the front support part 18 can preferably also generate a flash signalling the start of a swimming race.

Figure 3:
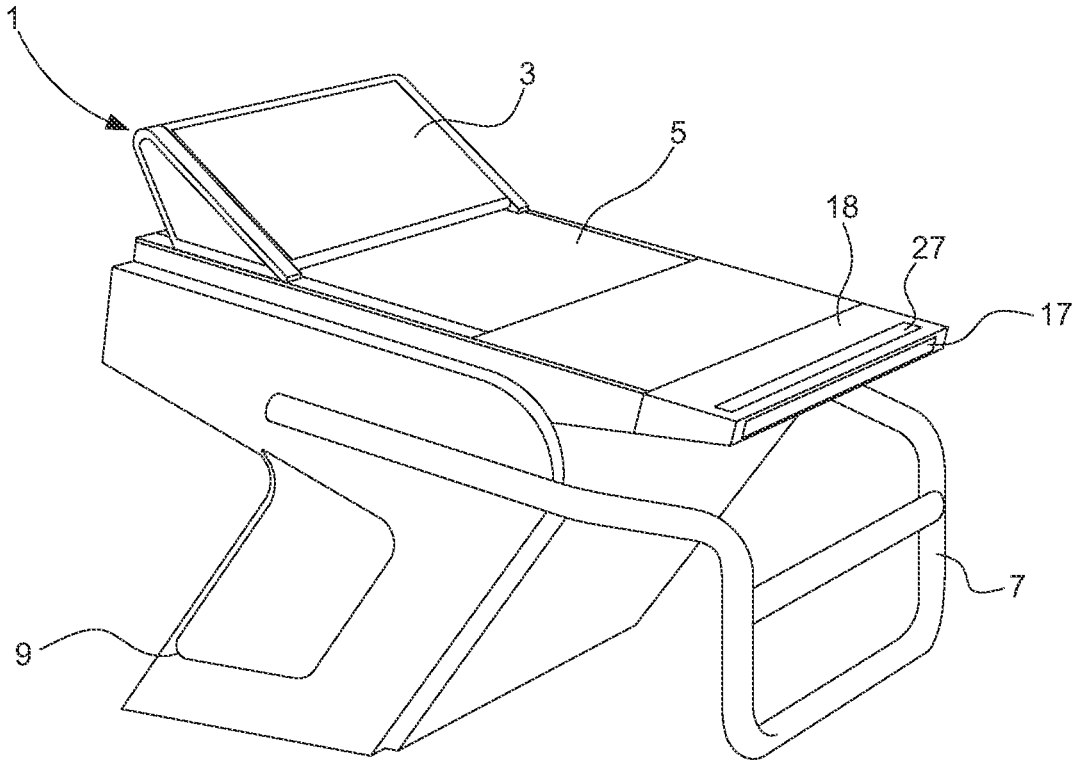
FIG. 3 represents another embodiment of a starting block with an intelligent front support part with an illumination on the top, or even on the top and the front of the part according to the invention.

According to a second embodiment represented in FIG. 3, there may be provided an illumination 27 on the top of the front support part 18. In this case, one or more light sources are provided in the form of light-emitting diodes LED. These diodes LED can be disposed on a line 27 parallel to the front edge of the front support part 18. A combination with an illumination through the slot 17 of the first embodiment can also be provided, as shown in FIG. 3.

It should also be noted that the front support part 18 can be electrically connected by cable to a supply voltage source of the starting block 1 or an external signal management station.

The front support part 18 is mounted or fixed to the front portion of the platform 5 in the continuity of the upper surface thereof and in an ergonomic manner. The front support part 18 comprises nesting means to be held fixedly in an opening of the front portion of the platform 5. The front support part 18 can for example be screwed or clipped in a shape complementary to the opening of the front portion of the platform 5 or by any other fixing means. In this case, it can be removed from the opening of the platform by acting, for example, on buttons disposed in the vicinity of the opening on the front of the platform or on the sides of the front support part to displace the portions clipped against the retaining spring of the front support part fixed in the opening of the platform 5.

However, other fastening means may be provided. The front support part 18 may comprise a rigid tab to be inserted into an opening whose shape is complementary the front portion of the platform 5. The front portion of the platform 5 may comprise several bottomed openings to house the screw head. Several threads are made following the openings in the front portion of the platform 5 and by passing through openings made on the tab of the front support part 18. Thus, the front support part is fixed by a set of screws screwed into the threads which are made. Reverse fixing means of what is described above can be performed.

It can also be imagined to make two grooves over the entire length of two opposite sides of the front support part to slidably insert this portion of the front support part 18 into a jaw with rectilinear teeth of the front portion of the platform 5. The teeth of the jaw are disposed to be housed in each groove and fixed once the front support part is in the continuity of the upper surface of the platform.

Still other means for fixing the front support part 18 on the front portion of the platform 5 can be imagined without departing from the scope of the invention defined by the claims. These may be mechanical fixing means to have a front support part 18 which is easily interchangeable in the case of wear or by also using electrical means which are little more complicated.

What is claimed is:

1. A support part (18) of a starting block (1) of a swimming race, the starting block (1) comprising at least one base (9) to be fixed around a swimming pool; and a platform (5) which is mounted or fixed on the base (9), on which a foot of a swimmer as well as his hands are supported before the start of a race, wherein the support part (18) is an intelligent front support part, which comprises race management electronics, in particular at the time of the start of the race, and which comprises nesting means to be held fixedly and interchangeable in an opening of the front portion of the platform (5) and wherein the front support part (18) is screwed or clipped in a shape complementary to the opening of the front portion of the platform (5).

2. The support part (18) according to claim 1, wherein the front support part (18) is mounted or fixed to the front portion of the platform (5) in the continuity of the upper surface thereof, said front support part (18) being configured to ensure a good grip of the hands.

3. The support part (18) according to claim 1, wherein the front support part comprises at least one force or movement sensor connected to a processor processing unit to determine the reaction time of the swimmer at the start of a race in order to determine at least any false starts.

4. The support part (18) according to claim 1, wherein the front support part (18) defined as the front portion comprises at least one light source for illuminating through a slot (17) on the front portion of the front support part at least one race lane in front of the starting block (1).

5. The support part (18) according to claim 4, wherein the slot (17) is disposed horizontally over the entire length of the front support part (18).

6. The support part (18) according to claim 1, wherein the front support part (18) defined as the front portion comprises at least one light source to generate a race start flash through a slot (17) on the front portion of the front support part (18).

7. The support part (18) according to claim 1, wherein the front support part (18) defined as the front portion comprises at least one light source to generate a race start flash, and wherein the light source (27) is a light-emitting diode disposed on top of the front support part (18).

8. The support part (18) according to claim 7, wherein several light-emitting diodes are provided disposed on top of the front support part (18).

9. The support part (18) according to claim 1, wherein the front support part (18) is removed from the opening of the platform by acting on buttons disposed in the vicinity of the opening on the front of the platform (5) or on the sides of the front support part (18) to displace the portions clipped against the retaining spring of the front support part (18) fixed in the opening of the platform (5).

10. The support part (18) according to claim 1, wherein the front support part (18) comprises two grooves over the entire length of two opposite sides of the front support part (18) to slidably insert the grooved portion into a jaw with rectilinear teeth of the front portion of the platform (5), where the teeth of the jaw are disposed to be housed in each groove.

* * * * *